US010930121B2

(12) United States Patent
Moore et al.

(10) Patent No.: US 10,930,121 B2
(45) Date of Patent: Feb. 23, 2021

(54) SYSTEMS AND METHODS FOR GENERATING WAGERING OPPORTUNITIES IN AN ELECTRONIC BACCARAT GAME BASED ON DATA OF AT LEAST ONE LIVE BACCARAT TABLE GAME

(71) Applicant: Walker Digital Table Systems, LLC, Las Vegas, NV (US)

(72) Inventors: Stephen Moore, Las Vegas, NV (US); Michael Russell, Las Vegas, NV (US); John Daley, Las Vegas, NV (US); Keith Atkinson, Henderson, NV (US)

(73) Assignee: Walker Digital Table Systems, LLC, Las Vegas, NV (US)

( * ) Notice: Subject to any disclaimer, the term of this patent is extended or adjusted under 35 U.S.C. 154(b) by 0 days.

(21) Appl. No.: 16/656,373

(22) Filed: Oct. 17, 2019

(65) Prior Publication Data

US 2020/0051401 A1 Feb. 13, 2020

Related U.S. Application Data

(63) Continuation of application No. 15/116,391, filed as application No. PCT/US2015/015985 on Feb. 15, 2015, now Pat. No. 10,490,029.

(60) Provisional application No. 62/076,527, filed on Nov. 7, 2014, provisional application No. 61/945,729, filed on Feb. 27, 2014, provisional application No. 61/940,427, filed on Feb. 15, 2014.

(51) Int. Cl.
*G07F 17/32* (2006.01)

(52) U.S. Cl.
CPC ..... *G07F 17/3293* (2013.01); *G07F 17/3225* (2013.01); *G07F 17/3276* (2013.01)

(58) Field of Classification Search
CPC ..... A63F 2001/001; A63F 2003/00164; G07F 17/3225; G07F 17/3237; G07F 17/326; G07F 17/3267; G07F 17/3272; G07F 17/3288; G07F 17/3293
See application file for complete search history.

(56) References Cited

U.S. PATENT DOCUMENTS 6,217,447 B1 4/2001 Lofink et al.
2003/0109310 A1 6/2003 Heaton et al.
(Continued)

OTHER PUBLICATIONS

Written Opinion for PCT/US15/015985 dated May 20, 2015; 9 pps.
(Continued)

*Primary Examiner* — Omkar A Deodhar
(74) *Attorney, Agent, or Firm* — Fincham Downs LLC; Magdalena M. Fincham

(57) ABSTRACT

In accordance with some embodiments, a system which includes a plurality of baccarat tables on which a baccarat game may be played by a plurality of players and a plurality of electronic player devices each playable by an individual player provides for selecting a plurality of outcomes which were dealt on at least one of the baccarat tables, determining whether a trend or pattern has developed in the plurality of outcomes (e.g., a pattern of at least a predetermined length) and, if a pattern has developed, activating a wagering opportunity on one of the electronic player devices, the wagering opportunity allowing a player to bet for or against the trend. In one embodiment, each outcome of the plurality of selected outcomes comprises an outcome originally dealt on the same baccarat table.

17 Claims, 7 Drawing Sheets

(56) References Cited

U.S. PATENT DOCUMENTS

| | | | |
|---|---|---|---|
| 2008/0085769 | A1 | 4/2008 | Lutnick |
| 2008/0305855 | A1 | 12/2008 | Czyzewski et al. |
| 2010/0171267 | A1 | 7/2010 | Walker |

OTHER PUBLICATIONS

International Search Report for PCT/US15/015985 dated May 20, 2015; 2 pps.
First Examination Report for Australian Application No. 2015218314 dated Feb. 10, 2017; 3 pps.
Written Opinion for Singapore Application No. 11201605809T dated Feb. 13, 2017; 6 pps.
Written Opinion for Singapore Application No. 11201605809T dated Oct. 19, 2017; 5 pps.
Written Opinion for Singapore Application No. 11201605809T dated Aug. 10, 2018; 8 pps.
Office Action for Korean Application No. 10-2016-7024650 dated Dec. 19, 2017; 19 pps.
Notice of Allowance for Korean Application No. 10-2016-7024650 dated Jun. 25, 2018; 4 pps.
Office Action for Canadian Application No. 2939129 dated Aug. 9, 2017; 5 pps.
Office Action for Canadian Application No. 2939129 dated Jul. 9, 2018; 6 pps.
Office Action for Chinese Application No. 201580015741.X dated Feb. 2, 2019; 18 pps.
Office Action for Philippines Application No. 1-2016-501620 dated Apr. 22, 2019, 5 pps.
Notice of Eligibility for Singapore Application No. 11201605809T dated Jul. 15, 2019; 2 pps.
Examination Report for Singapore Application No. 11201605809T dated Jun. 21, 2019; 4 pps.
Office Action for Canadian Application No. 2939129 dated Jun. 7, 2019; 6 pps.
Office Action for U.S. Appl. No. 15/116,391 dated Mar. 1, 2019; 7 pps.
Notice of Allowance for U.S. Appl. No. 15/116,391 dated Jul. 30, 2019; 5 pps.

500

| DRAW DATE/TIME 502 | TABLE IDENTIFIER 504 | OUTCOME 506 |
|---|---|---|
| 2014-05-01 04:59:13.808+08 | MB871 | PLAYER |
| 2014-05-01 04:59:39.767+08 | MB867 | PLAYER |
| 2014-05-01 04:59:45.335+08 | MB886N | BANKER |

FIG. 5

SYSTEMS AND METHODS FOR GENERATING WAGERING OPPORTUNITIES IN AN ELECTRONIC BACCARAT GAME BASED ON DATA OF AT LEAST ONE LIVE BACCARAT TABLE GAME

CLAIM OF PRIORITY

This application is a Continuation Application of U.S. application Ser. No. 15/116,391 filed on Aug. 3, 2016 in the name of Moore et al. and titled SYSTEMS AND METHODS FOR GENERATING WAGERING OPPORTUNITIES IN AN ELECTRONIC BACCARAT GAME BASED ON DATA OF AT LEAST ONE LIVE BACCARAT TABLE GAME, which U.S. Application is a National Phase Application filed under 35 U.S.C. § 371 of PCT/US15/015985 filed on Feb. 15, 2015 in the name of Moore et al. and titled SYSTEMS AND METHODS FOR GENERATING WAGERING OPPORTUNITIES IN AN ELECTRONIC BACCARAT GAME BASED ON DATA OF AT LEAST ONE LIVE BACCARAT TABLE GAME; the foregoing PCT Application claims the benefit of (i) U.S. Provisional Application No. 61/940,427 filed Feb. 15, 2014 in the name of Stephen Moore, titled SYSTEMS AND METHODS FOR FACILITATING WAGERING OPPORTUNITIES BASED ON TABLE GAMES; (ii) U.S. Provisional Application No. 62/076,527 filed Nov. 7, 2014 in the name of Stephen Moore et al., titled SYSTEMS AND METHODS FOR FACILITATING WAGERING OPPORTUNITIES BASED ON TABLE GAMES; and (iii) U.S. Provisional Application No. 61/945,729 filed Feb. 27, 2014 in the name of, titled SYSTEM AND METHOD FOR FACILITATING REMOTE WAGERING GAMES USING LIVE GAME PLAY DATA. The entirety of each of the foregoing Applications is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

SUMMARY

The embodiments described herein relate generally to systems and methods for providing, conducting and facilitating the play of an electronic games, such as a baccarat game (e.g., a wagering version of a baccarat game, such as may be playable on a dedicated specialized baccarat device located in a wagering establishment). In particular, embodiments described herein provide for facilitating additional wagering opportunities for players of electronic games based on game play data of live table games.

Wagering games such as baccarat, blackjack, roulette, and various poker-based table games are popular games offered in casinos. These games are sometimes played on physical gaming tables located throughout the casino floor. Sometimes such tables may have a felt layout on which a dealer deals shuffled cards to the players and players wager with gaming chips. Other times the tables may comprise fully automated "smart" tables which have a virtual dealer and screens for each player position, depicting images of cards dealt to the respective players. There are also hybrid variations of such physical tables (e.g., a virtual dealer but using physical playing cards and/or chips). For some physical tables shuffled cards may be provided by an automated shuffler or through a card dealing shoe containing multiple decks of shuffled cards. Irrespective of how automated or non-automated a physical table game may be, the outcomes determined for the live table game are typically determined randomly. For example, a dealer may shuffle cards from one or more decks and deal them out after the cards have been shuffled and/or cut. In another example, an automated card dealing mechanism may cause the cards of one or more decks to be shuffled and/or cut prior to being dealt. In yet another example, a random number generator (comprising software and/or hardware for selecting cards to be dealt for a hand or other game event on a random or pseudo-random basis) may be utilized to determine the cards to be dealt as an outcome of a hand, bet or other game event. The game data determined from such live physical tables which is received, derived, stored and/or utilized to create additional wagering opportunities in embodiments described herein is referred to as "live game play data" herein. The live game play data may include, for example, an indication of at least one of (i) an outcome determined for a respective one or more hands, bets or other game events; (ii) a result determined for a respective one or more hands, bets or other game events (e.g., a payout won, an indication of a winner for a hand, bet or other game event), (iii) a rank or characteristic of a hand, bet or other game event; (iv) a suit, rank or other characteristic of a card or other game indicia output for a respective one or more hands, bets or other game events; (v) the one or more cards or other game indicia output for a respective one or more hands, bet or other game events. It should be noted that there may be some overlap in the scope of the examples listed above (e.g., an indication of an outcome in a card game may comprise an indication of a card comprising the outcome).

In accordance with some embodiments, the live game play date of one or more table games (played, for example, on one or more physical tables) may be stored, analyzed, manipulated, repurposed or otherwise utilized to create additional wagering opportunities (e.g., in the context of an electronic wagering game). The data, after it is repurposed, manipulated, or otherwise utilized to create the additional wagering opportunities is referred to as "repurposed game play data" herein. It should be noted that the same data (e.g., an outcome for a hand of baccarat) may be both live game play data at a first time in a process described herein and repurposed game play data at a second time in a process described herein. For example, assume an outcome of "Player" is determined for a hand in a live game of baccarat at a physical table. The fact that the "Player" side won that hand in the baccarat game may be considered as live game play data as it is received from the live table game and stored for future use. Later, if that outcome is selected for use in a wagering opportunity in accordance with some embodiments, the outcome may be stored as repurposed game play data for the wagering opportunity.

Whether a table game is fully automated, a traditional table with a live dealer and physical cards and chips, or somewhere in between, these platforms suffer from some disadvantages. For example, they have a limited capacity for players to participate in any particular game due to a limited number of player positions or a limitation on physical space about the table. Also, for players who enjoy identifying and betting on trends at various tables (e.g., whether the banker or player side keeps winning in a baccarat game), wagering via physical tables poses logistical and timing issues due to the player needing to walk throughout the casino and review game play data of individual tables in order to identify potential trends (e.g., outcome trends) that the player may desire to wager on.

BRIEF DESCRIPTION OF THE DRAWINGS

FIG. 5 comprises a table illustrating one example of how data comprising outcomes obtained in a live baccarat game may be stored, in accordance with some embodiments.

DETAILED DESCRIPTION OF EMBODIMENTS

Figure 1A:
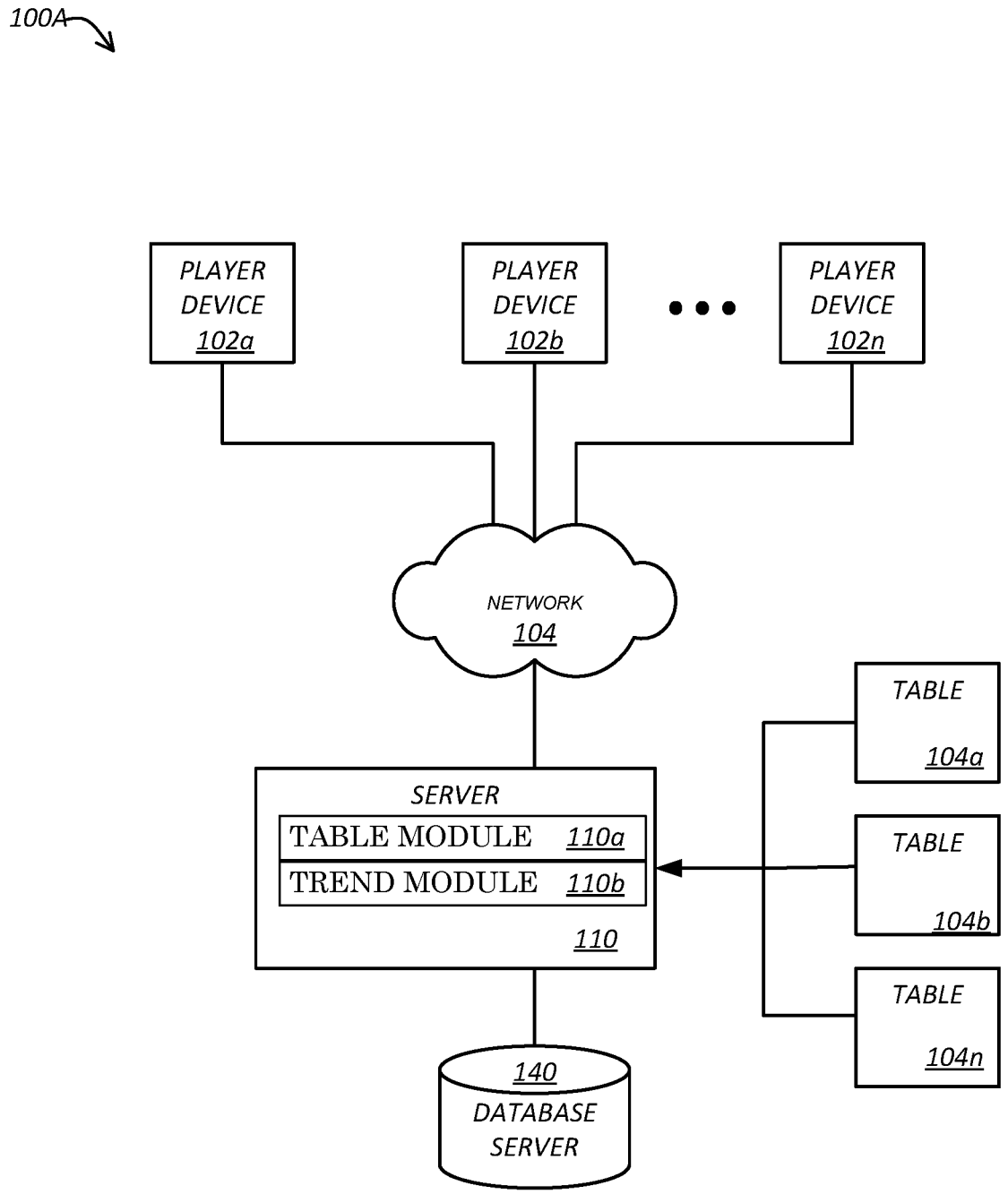
FIGS. 1A and 1B each comprise block diagrams which illustrate respective embodiments of systems which may be operable to facilitate at least some of the functionalities and processes described herein.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a player device such as a personal computer online in web browsers, on a game console and/or on a mobile device such as a smart-phone or tablet computer or on a dedicated device on a casino floor. In one embodiment, an electronic baccarat game is playable on a dedicated gaming device in a wagering establishment which is specially configured to facilitate and output the electronic baccarat game (e.g., the interfaces may be configured to output trends in a baccarat game and the buttons or other input mechanisms on the gaming device may be configured to accept input specific for the baccarat game). A game may also be played at a table configured for play of such game (e.g., a baccarat, poker or roulette game). "Gaming" thus refers to play of a game.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game. The terms "wager" and "bet" are used synonymously herein.

The term "game provider", as used herein unless specified otherwise, refers to an entity or system of components which provides games for play and facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may comprise a manufacturer or other provider of software and/or hardware for facilitating an electronic baccarat game as described herein. In one embodiment, a game provider comprises a wagering establishment such as a casino.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an electronic baccarat game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game), such as an interface of an electronic baccarat game.

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a dedicated device in a wagering establishment ("dedicated wagering device" herein), a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Examples of a dedicated device include, without limitation, (i) a physical table which includes an electronic component such as a processor for facilitating some parts of a card game, a display for outputting information to a player and/or a shoe for automatically dealing cards for the card game; (ii) a slot-machine like device; (iii) a console; (iv) a tablet or other mobile device dedicated to supporting games available at a gaming establishment and other activities related exclusively to the gaming establishment; and (v) a kiosk. Player and/or network devices may, in some embodiments, comprise one or more network components. A player device utilized to provide additional wagering opportunities using repurposed game play data may or may not be located in the same wagering establishment as the one or more tables from which live game play data was obtained and repurposed to provide the additional wagering opportunities. A player device may, in some embodiments, be remote from a table from which live game play data may have been obtained (e.g., at a previous time from the time at which a wagering opportunity is provided at the player terminal using data obtained from the table). For example, the player device may be located in a different area of a wagering establishment or in a different wagering establishment. In another example, a player device may be located in the same room or general area of the wagering establishment as such a table but not close or right next to the table. In some embodiments, a player device may output wagering opportunities comprising repurposed data comprising live data from a plurality of tables and may be remote from at least some of such tables.

A "session" comprises a period of time spanning a plurality of event instances, game instances or turns of the game, the session having a defined start and defined end. In a card game, a session may comprise multiple hands of the game. An "event instance", "game instance" or "turn" is triggered upon an initiation of, or request for, at least one result of the game by a player, such as an actuation of a "start" or "deal" mechanism, which initiation causes an outcome to be determined or generated (e.g., a random number generator is contacted or communicated with to identify, generate or determine a random number to be used to determine a result for the event instance or to randomly select an outcome from a set of previously stored outcomes achieved on one or more live games). An event instance or turn may comprise an event instance or turn of a primary game or an event instance or turn of a bonus round, mode or feature of the game. Accordingly, a session may refer to a session of a primary game or a session of a bonus round, mode or feature of the game, depending on the context.

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass prizes which may comprise awards, payouts, discounts, eligibility, advancement in a game or other benefits (whether monetary or non-monetary, tangible or intangible) to a player.

In accordance with some embodiments, systems and methods provide for determining, receiving or identifying live game play data generated (e.g., randomly) through the play of a live table game, such as a live baccarat game, and utilizing the game play data to create additional wagering opportunities for players, which additional wagering opportunities may be made available on a player device (e.g., a mobile player device such as a tablet computing device or a dedicated wagering device on a casino floor, distinct from any table from which the game play data may have been derived or determined). In accordance with some embodiments, the additional wagering opportunities may comprise opportunities to bet on whether a trend or pattern in outcomes will continue (e.g., whether a trend in the Banker side or the Player side winning hands will continue for a baccarat game). In accordance with some embodiments, the wagering opportunities may be provided essentially contemporaneously or during the live table game based on the outcomes of which the wagering opportunities are determined, created or provided. In other embodiments, the wagering opportunities may be provided subsequent to (e.g., immediately after (e.g., within five minutes) or at some substantial time after (e.g., more than an hour after)) the live table game based on the outcomes of which the wagering opportunities are determined, created or provided. In some embodiments, the wagering opportunities may be created, generated, developed, determined, identified or provided based on game play data from a plurality of live table games (e.g., which may have occurred at different times, at different tables and/or in different casinos).

Live table games generally include a live dealer that deals randomly-ordered physical playing cards to players seated at a physical gaming table, and involves the use of physical gaming chips for wagering by the players at the gaming table during the play of the game. A live table game may also involve an automated system for dealing physical playing cards to players seated at a physical gaming table but without a live dealer present (e.g., the physical table may provide for a remote dealer or software which simulates a dealer).

In accordance with some embodiments, live game play data may be obtained through wager detections systems, which may include at least one of hardware and software for identifying, storing, analyzing and/or transmitting events (e.g., results, outcomes, wagers, etc.) which have occurred during or in association with a live table game. For example, a wager detection system may include at least one of RFID tagged gaming chips and corresponding RFID sensing devices, one or more card reading devices, such as a camera positioned to capture card images for detection, an optical reader incorporated in a gaming table, an automated shuffling device and a playing card shoe (e.g., an electronic shoe which is operable to communicate with a processor to indicate at least one of an outcome or result of a wager and/or the game symbols comprising an outcome for a wager). Once received or otherwise determined, the live game play data may be stored, processed, analyzed, selected and/or communicated as repurposed game play data for display on one or more player devices through any appropriate wired or wireless communication hardware and software technology.

The systems, processes and articles of manufacture described herein may be operable to utilize the live game play data as repurposed game play data to provide games or wagering opportunities at one or more of player devices. The wagering opportunities or games so provided may be based on, or simulations of, the live game play data of the underlying game or original game from which the data originated. In one embodiment, the systems, methods and articles of manufacture described herein may be operable to provide additional wagering games or opportunities which differ from the underlying or original game based upon which the game data was determined.

For example, in accordance with one embodiment a process provides for selecting (e.g., on a random basis) a plurality of outcomes (e.g., one at a time) from the live game play data of a physical table at which a plurality of players are playing a game of baccarat (whether such selection is done in real time as the outcomes are determined for the table or from outcomes previously determined for the table and stored in a memory device). In a more particular example, a processor of a system may be programmed to select an outcome of a baccarat game (e.g., whether a Player or Banker side won a particular hand) and, after a predetermined number of such selections, analyze the selected set of outcomes to determine whether there is a trend developing (or that has occurred) in the selection (e.g., that Banker winning is the outcome selected for the last X selections, where X is a predetermined minimum number such as three (3) or five (5)). Applicants have recognized that some players of table games enjoy identifying trends in outcomes and betting on whether the trend will continue or not (e.g., if Banker is the winning side for the past 5 outcomes, betting that the trend will continue may comprise betting that the next outcome selected will also be an outcome of the Banker side as the winner).

A trend in baccarat outcomes, as this term is used herein, may comprise any discernable pattern in a sequence of outcomes (e.g., PPP or BBB, PP-BB-PP-BB-P, wherein "B" stands for Banker side win and "P" stands for Player side win). When a player is provided with an opportunity to wager on whether a trend will continue, this means (in accordance with some embodiments) that the player is provided an opportunity to wager on whether the trend will continue or be broken when the next outcomes is added to the sequence of outcomes comprising the trend. For example, if the trend is B-B-B, the player may be provided with an opportunity to wager on whether the next outcome added to this sequence of outcomes will be another Banker side win (in which case the trend would be determined to have continued with this next outcome) or a Player side win (in which case the trend would be determined to have been broken; the same determination may be made in some embodiments if the next outcome were a Tie, depending on the rules of the game).

It should be noted that an outcome may be selected from a pool of available live game play data in a variety of manners. In one embodiment, all outcome data indicating live game play data may be stored in a single pool of outcomes which are randomly selected one at a time to create a sequence of outcomes comprising repurposed game play data. The sequence of outcomes may then be analyzed to determine if a trend or pattern is present in the randomly selected outcomes and, if so, further selecting for the sequence may be paused and the sequence of outcomes may be output to a player via a player terminal as a wagering opportunity (e.g., the player may be invited to bet on whether the next outcome selected will continue or break the trend or pattern). In some embodiments, when data indicating an outcome dealt for a live game is stored (e.g., outcome data for a particular hand dealt at a physical table), such data is stored in association with one or more tags, information or characteristics of the outcome. For example, at least one of the following may be stored in association with each outcome comprising live game play data: (i) the table at which the outcome occurred; (ii) an indication of a shoe from which the outcome was dealt; (iii) a time at which the outcome was dealt; (iv) at least one player associated with the outcome; (v) a dealer associated with the outcome; and (vi) at least one other outcome dealt prior to the subject outcome and/or at least one other outcome dealt subsequent to the subject outcome (e.g., to help determine whether the subject outcome was part of a pattern or trend in the original live game play data).

In some embodiments, any of the above information may be used when selecting outcomes to create repurposed game play data. For example, in one embodiment outcomes may be selected pseudo-randomly but with one or more restrictions. Examples of such restrictions include, without limitation, (i) two selected outcomes consecutively selected for the repurposed game play data may not have occurred consecutively during a live game; (ii) outcomes selected as repurposed game play data must come from the same table; and (iii) outcomes selected as repurposed game play data must not have been dealt from the same shoe during a live game. In one embodiment, selecting outcomes as repurposed game play data may comprise a two-step process. In the first step, a subset of all available live game play outcomes is created by filtering the outcomes for the desired restrictions or characteristics (e.g., only outcomes from a particular physical table or tables are selected for the subset). In the second step, outcomes are selected from the subset one by one to create a sequence of outcomes and analyzing the sequence as it is created to determine whether a trend or patterns is present in the selected sequence.

In accordance with one embodiment, an example process for repurposing live game play data to create additional wagering opportunities for players may comprise: (i) accessing previously stored live game play data, the live game play data indicating outcomes which occurred on at least one physical table over a course of at least one session of play of a type of card game; (ii) selecting (e.g., randomly or in accordance with an algorithm for such selection), from the live game play data, a plurality of outcomes; (iii) determining that a minimum or predetermined number of outcomes have been selected; (iv) analyzing the selected outcomes to determine whether a trend is present in the outcomes (e.g., whether there is a characteristic common to at least a predetermined subset of the outcomes); (v) if it is determined that a trend is present in the selected outcomes, continuing to step (vi), otherwise selecting an additional outcome from the live game play data and returning to step (iv); (vi) causing a wagering opportunity to be output to a player, the additional wagering opportunity indicating the outcomes selected, the trend identified and an opportunity for the player to bet on whether the trend will continue with the next selected outcome; (vii) selecting an additional outcome from the set of live game play data for the set of outcomes; (viii) analyzing the selected outcomes, including the outcome selected in (vii) to determine whether the trend has continued; and (ix) determining whether the player has won the bet based on whether the trend has continued and the bet placed. In some embodiments, the selecting of the additional outcome in step (vii) may be performed after the player has placed a bet on the additional wagering opportunity. In other embodiments, the selecting may be performed after the system has determined that a trend is present and that an additional wagering opportunity should be made available based on the outcomes that had been selected up to that point but prior to a player placing a bet on the trend (or even prior to the additional wagering opportunity being output as available to a player).

In accordance with some embodiments, systems, processes or articles of manufacture (e.g., non-transitory computer readable media) may provide for executable programs configured to display repurposed game play data at one or more player devices (e.g., to be sorted by table, game, activity or other features of the game, such as minimum or maximum wagering, and provide for interactivity to enable sorting and correlating) in order to facilitate players identifying wagering opportunities of interest. In accordance with some embodiments, a program may be configured to recognize (and, in some embodiments, provide a visual or audio cue to a user such as a player) when a trend or pattern in repurposed game play data satisfies a predetermined criteria (e.g., has reached a certain threshold, such as when the repurposed game play data comprises a minimum or predetermined number of a like type of outcome (or outcomes) that share at least one common characteristic) which have been selected in a sequence for a set of outcomes, such as four or more player winning results in a baccarat game.

In accordance with some embodiments, systems, processes and articles of manufacture provide for conducting and/or facilitating play of wagering games at one or more player devices through the use of randomly selected live game play data previously received or determined from the play of one or more live wagering games at one or more physical gaming table. It is contemplated that the selected live game play data may be repurposed to offer additional wagering games at one or more player devices which may possess at least one characteristic which is shared by the underlying wagering game from which the live game play data was received. That is, in accordance with some embodiments the additional wagering opportunities may be output so as to simulate the underlying wagering game, or possess different characteristics, thus allowing a greater range of wagering opportunities at the player devices.

Referring now to the figures, FIG. 1 depicts a block diagram of an example system 100A according to some embodiments. The system 100A may comprise a plurality of player devices 102*a*-102*n* and a plurality of tables 104*a*-104*n*, the foregoing in communication with at least one server 110 via a network 108 (in some embodiments the server 110 may also communicate with the plurality of tables 104*a*-104*n* via a network, such as network 108 or another network). For purposes of brevity, any or all of the player devices 102*a*-102*n* will be referred to as a player device 102 herein, even though the plurality of player devices 102*a*-102*n* may include different types of player devices (as described below). Similarly, even though a plurality of tables 104*a*-104*n* are illustrated, these will simply be referred to as a table 104 herein. In different embodiments, a table 104 may comprise a completely automated smart table (e.g., with a virtual dealer), or a table with a live dealer. A table 104 may comprise any table on which a baccarat card game may be played, of which game the outcomes may be determined and repurposed in order to generate wagering opportunities in an electronic baccarat game playable on at least one player device 102, whether the determination of the outcomes is done via a processor associated with the table 104, via a nearby camera which records such outcomes and transmits them to a processor for use in embodiment described herein or via another mechanism.

In accordance with some embodiments, the server 110 may also be operable to communicate with or access a database server 140 (which may comprise one or more databases and/or tables and which may comprise a storage device distinct from (or be a component of) the server 110). The database server 140 may store, for example, data comprising outcomes obtained on one or more tables 104. Other examples of data which may be stored in database server 140 include, without limitation, (i) one or more databases for determining one or more outcome(s) for an event instance, hand or turn of a baccarat game, (ii) a current state or status of a game or game session (e.g., the outcomes determined so far for a trend), (iii) one or more user interfaces for use in a game, (iv) one or more game themes for a game and/or (v) profiles or other personal information associated with a player of a game. It should be noted that in some embodiments such data may be stored on the server 110 and information based on such data may be output to a player device 102 during play of a game (e.g., periodically, at certain predetermined phases of the game or as new data becomes available) while in other embodiments a game program may be downloaded to a local memory of a player device 102 and thus such data may be stored on a player device 102 (e.g., in encrypted or other secure or tamper-resistant form). An example of a table which may be stored in database server 140 is illustrated in FIG. 5. It should be noted that in some embodiments data described herein as being stored in database 140 may instead be stored on server 110 or another computing device (e.g., a player device and/or server 120 of system 100B (FIG. 1B)).

In some embodiments a processor (e.g., one or more microprocessors, one or more microcontrollers, one or more digital signal processors) of a player device 102, a table 104 and/or server 110 may receive instructions (e.g., from a memory or like device), and execute those instructions, thereby performing one or more processes defined by those instructions. Instructions may be embodied in, e.g., one or more computer programs and/or one or more scripts. In some embodiments, the database 140 may be operable to store live game play data, such as outcomes generated or obtained on a live table game played on a table 104, which live game play data may then be used as repurposed game play data for one or more player devices 102.

A server 110 may comprise a computing device for facilitating play of a game on one or more tables 104 (e.g., by receiving an indication of a wager placed by a player participating at a game at a table, determining cards dealt for a hand in the game, calculating a commission owed by a player or a payout owed by the dealer to a player of the game) and/or one or more player devices 102 (e.g., selecting outcomes comprising a trend and outputting a wagering opportunity on the trend, receiving an indication of an input from a player to a player device 102, such as an input indicating placement of a wager on the trend). For example, the server 110 may comprise a server computer operated by a game provider or another entity (e.g., a casino which makes electronic baccarat games available to players in accordance with embodiments described herein). In some embodiments, the server 110 may determine an outcome for game event of a game by requesting and receiving such an outcome from another remote server operable to provide such outcomes (e.g., a server associated with one or more tables 104, which server collects outcome data from such tables, in embodiments in which such functionality is not performed by server 110). In some embodiments, server 110 may comprise two or more server computers operated by the same entity (e.g., one server being primarily for storing states of games in progress and another server being primarily for storing mechanisms for determining outcomes of games, such as a random number generator).

In accordance with some embodiments, server 110 may comprise various software modules, programs or engines for performing certain functionality. In the embodiment of FIG. 1A, server 110 comprises (i) a table module 110*a* for managing and facilitating data of games conducted on one or more tables 104; and (ii) a trend module 110*b*, for managing and facilitating wagering opportunities on trends of a baccarat game as made available on one or more player devices 102. A software module or program may comprise one or more instructions (e.g., embodied on a non-transitory computer-readable medium such as a memory accessible to a processor) for directing the processor (e.g., a processor of server 110 in the context of table engine 110*a* and trend engine 110*b*) to perform certain functions. In accordance with some embodiments, software components, applications, routines or subroutines, or sets of instructions for causing one or more processors to perform certain functions may be referred to as "modules". It should be noted that such modules, or any software or computer program referred to herein, may be written in any computer language and may be a portion of a monolithic code base, or may be developed in more discrete code portions, such as is typical in object-oriented computer languages. In addition, the modules, or any software or computer program referred to herein, may in some embodiments be distributed across a plurality of computer platforms, servers, terminals, and the like. For example, a given module may be implemented such that the described functions are performed by separate processors and/or computing hardware platforms.

In accordance with some embodiments, table module 110*a* may be operable to receive data (e.g., in real time, as games are played) from one or more tables 104. The table module 110*a* may, in some embodiments, exchange data with the one or more tables 104 in order to facilitate a game playable on the one or more tables (e.g., the table module may determine, calculate, activate or generate wagering data such as wagering opportunities (or odds for wagering opportunities) during a game, payouts due to players and/or commissions or other fees owed by players based on progress during a game). In accordance with some embodiments, the table module 110*a* may receive data comprising outcomes (e.g., cards comprising hands dealt in a baccarat game) of a game being played on a table 104. In accordance with some embodiments, table module 110*a* may communicate or provide at least some of the data it receives from one or more of the tables 104 to (i) trend module 110*b*; (ii) database server 140 (e.g., for storage and subsequent retrieval); and/or (iii) another component or device. In accordance with some embodiments, trend module 110*b* may be operable to facilitate an electronic baccarat game playable on one or more player devices 102. For example, the trend module 110*b* may be operable to (i) select or receive a plurality of outcomes obtained on one or more tables 104 (e.g., by selecting such outcomes randomly from data received from one or more tables 104 or from database server 140), (ii) determine whether the selected outcomes comprise a qualifying trend which may be output as a wagering opportunity to a player of a player device 102 and (iii) outputting the qualifying trend as a wagering opportunity available on a player device 102 (or directing the player device 102 to output the wagering opportunity).

Turning now to a description of a player device 102, in accordance with some embodiments a player device 102 may comprise a computing device that is operable to execute or facilitate the execution of a game program and used or useful by a player for playing an electronic baccarat game which allows the player to wager on trends generated based on repurposed game play data. For example, a player device 102 may comprise a computing device dedicated to gaming, a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™

Figure 2:
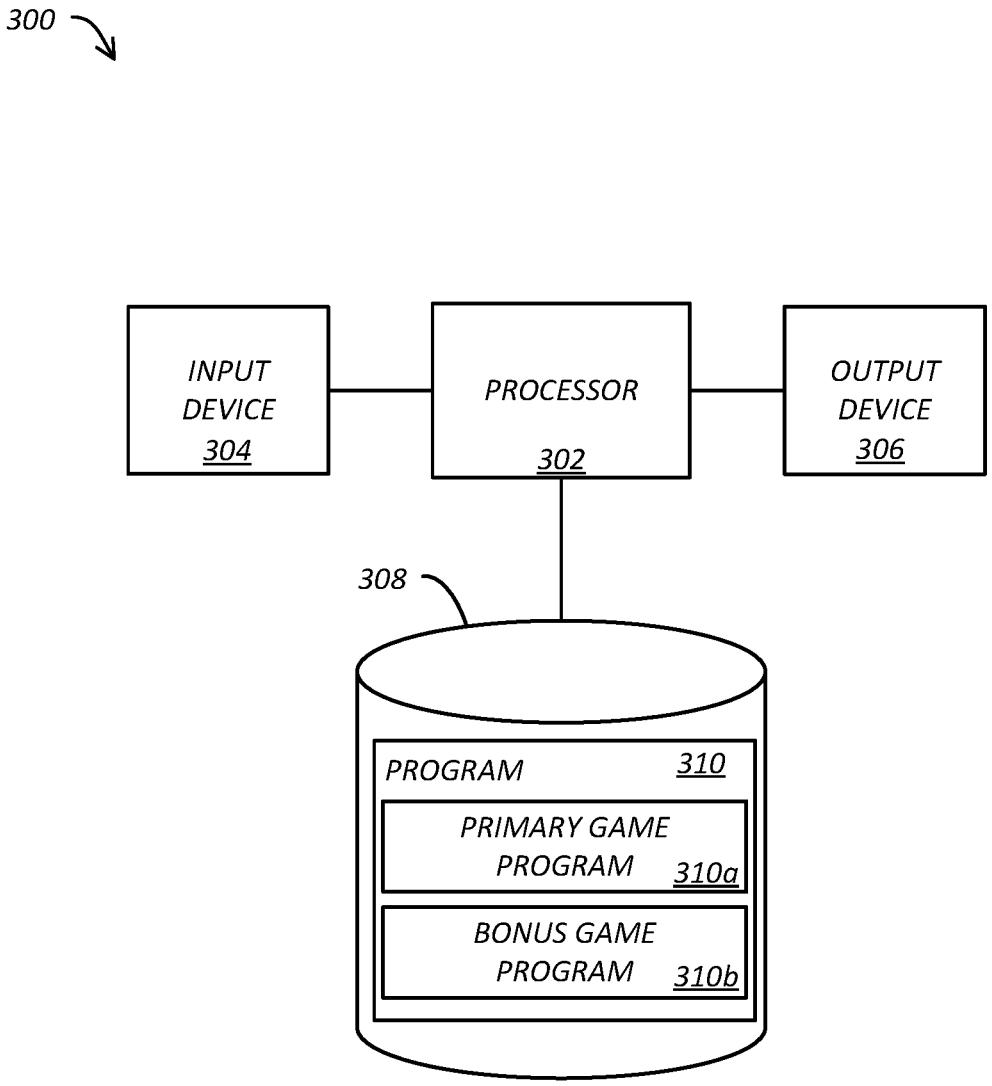
FIG. 2 comprises a block diagram of an example apparatus 200, which may be part of a system such as system 100A (FIG. 1A) or system 100B (FIG. 1B).

Xbox360™, Sony™ Plasystation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, server 110. A player device 102 may be a dedicated gaming device (e.g., a slot machine or video terminal on a casino floor) or a non-dedicated gaming device (e.g., an iPad™). FIG. 2 illustrates one example of a player device 102. It should be noted that a server 110 may be in communication with a variety of different types of player devices 102.

A player device 102 may be used to play (e.g., wager on) an electronic baccarat game over a network and output information relating to the game to players participating in the game (e.g., outcomes for an event instance of the game, qualifying for a bonus round of the game, outcomes determined for a bet, a result of a bet, credit balance of credits available for play of the game, etc.). For example, a player device may comprise a dedicated device (e.g., a video baccarat gaming cabinet located in a casino) which outputs a video baccarat game comprising one or more opportunities for a player to wager on a baccarat trend, wherein the baccarat trend may comprise repurposed game play data obtained from one or more tables 104. Any and all information relevant to any of the aforementioned functions may be stored locally on one or more of the player devices 102 and/or may be accessed using one or more of the player devices 102 (in one embodiments such information being stored on, or provided via, the server 110). In another embodiment, a player device 102 may store some or all of the program instructions for determining, for example, (i) that an event instance or game instance (e.g., beginning of a trend in a baccarat game) has been identified and/or made available for wagering (and, in some embodiments, communicating such an event instance to server 110), (ii) a result for a bet (e.g., which may comprise the payout won as a result of the bet), and/or (iv) modifying a game interface to reflect events within the game (e.g., showing the next outcome determined for a set of outcomes comprising a trend a player has placed a wager on). In some embodiments, the server 110 may be operable to authorize the one or more player devices 102 to access such information and/or program instructions remotely via the network 108 and/or download from the server 110 (e.g., directly or via an intermediary server such as a web server) some or all of the program code for executing one or more of the various functions described in this disclosure. In other embodiments, outcome and result determinations may be carried out by the server 110 (or another server with which the server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as within the same casino or area of a casino) or remote from all other player devices 102. Similarly, any given player device 102 may be located at the same location (or may be remote from) any of: (i) the server 110; and/or (ii) a table 104 from which live game play data is used as repurposed game play data for a game on the player device 102. It should further be noted that while the server 110 may be useful or used by any of the player devices 102 to perform certain functions described herein, the server 110 need not control any of the player devices 102. For example, in one embodiment the server 110 may comprise a server hosting a web site of an online casino accessed by one or more of the player devices 102.

A table 104 may comprise any table with a layout for facilitating a live baccarat game playable by a plurality of players at the table. As would be understood by one of ordinary skill in the art, a baccarat game table layout may comprise a dealer station and a plurality of player stations. In some embodiments, the dealer station may be sized to accommodate two dealers, one on either side (in some embodiments only a single dealer or more than two dealers may be utilized). The dealer station may include, for example, (i) a chip rack; (ii) commission indicia and/or area (for recording of any commissions that the player may owe), (iii) a banker hand indicia and/or area (e.g., the area to which the cards forming the banker hand are dealt), and (iv) tie bet indicia and/or area (where a player may indicate a wager on a tie between the banker hand and the player hand). Some baccarat tables also have display panels that indicate recent historical outcomes. Players sometimes use such historical outcomes in an effort to predict trends within a sequence of game instances at the table. Each player station may include a chip area where the player may position her chips. A player bet area may also be located in front of each chip area of a given player station. Additionally, each player station may include a bank bet area with appropriate indicia to link wagers placed therein to a particular player station. The dealers may use a shoe (which may be electronic and automatically deal and/or shuffle cards) to hold cards (one or more decks of cards) and a paddle or wand to move cards and/or chips to particular locations on the table as is well understood.

In some embodiments, a table 104 may not include any (or minimal) electronic components for facilitating a game other perhaps an automatic shoe for shuffling and dealing cards. Live game play data of a simple table may be detected by an auxiliary or separate device or system, such as cameras which record or detect game play events at the table or a computing system which communicates with a trend display board associated with the table. Such tables may be referred to as simple tables. Some tables 104 may include a live dealer but may be equipped with significantly more electronics for facilitating the game. For example, in some embodiments a table 104 may include RFID readers or antennas for detecting and tracking RFID-enabled chips placed on the table, displays for outputting information to the dealer and players, as well as a processor and attendant program for determining game events of the table (e.g., wagers placed or modified by players, movement of chips on the table, cards dealt for the game, outcomes of the game, payments made to or collected from players, etc.). Such tables may be referred to as smart live dealer tables. In still other embodiments, a table 104 may be fully automated in that it is essentially a computing device with one or more displays comprising a shape of a table, including a virtual dealer, yet still playable by a plurality of live players. Such a table may be referred to as a smart virtual dealer table. System 100A (and system 100B of FIG. 1B) may comprise different types of tables 104 and the embodiments described herein are not dependent on any particular type of table 104 being utilized. Irrespective of the type of table 104 being implemented (e.g., whether a simple table, a smart live dealer table or a smart virtual dealer table), a table 104 is operable to support a live baccarat game playable by a plurality of players in which live game play data is generated based upon a dealing of cards (whether manually by a dealer, from an electronic shoe, based on an RNG of a smart table, or otherwise). The system 100A is operable to determine the live game play data of one or more tables 104 and utilize it as repurposed game play data for an electronic baccarat game playable on one or more player devices 102.

Figure 1B:
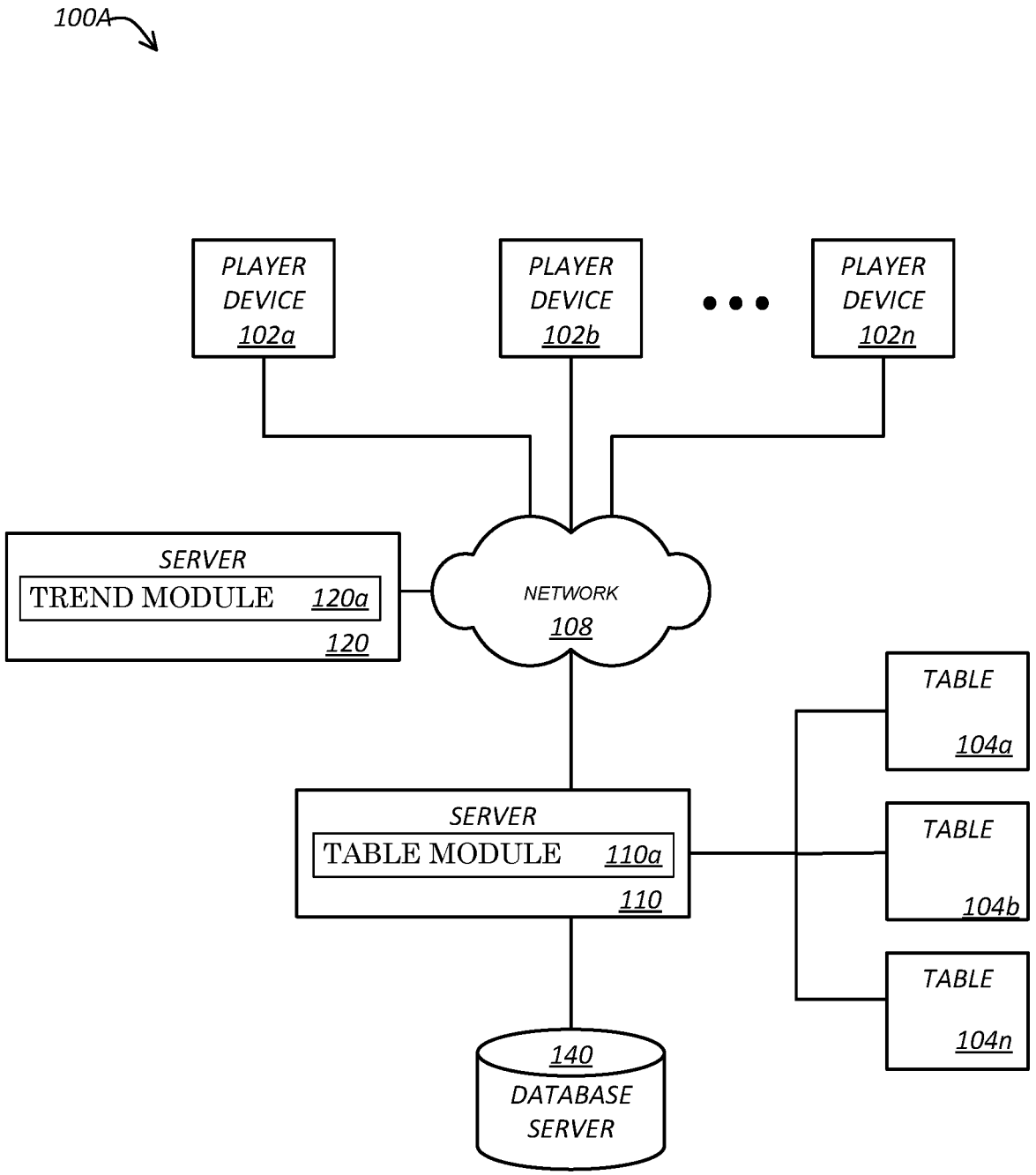

Turning now to FIG. 1B, illustrated therein is a block diagram of an example system 100B which may be utilized to implement one or more embodiments described herein. The system 100B includes many of the same components as system 100A of FIG. 1A. The components shown in system 100B which are also included in system 100A with the same reference numerals are not described here again for purposes of brevity. A difference between system 100A and 100B, however, is that system 100B include a server 120 which is distinct from server 110 and, while server 110 includes table module 110*a* it does not include trend module 110*b*. Instead, server 120 includes a trend module 120*a*. Trend module 120*a* may be operable to perform the functionalities described herein as being performed by trend module 110*a* of FIG. 1A or otherwise facilitate making available wagering opportunities on one or more player devices 102 (e.g., wagering opportunities comprising trends developed based on outcomes obtained on one or more tables 104). Thus, while in some embodiments such as illustrated in FIG. 1A the same server may operate to (i) receive data such as outcomes obtained one more or more tables 104 and facilitate games on the one or more tables 104; and (ii) determine, develop, generate or identify wagering opportunities to be made available on one or more player devices 102 (e.g., such wagering opportunities comprising trends based on outcomes obtained on one or more tables 104), in other embodiments such as illustrated in FIG. 1B, these two types of functionalities may be performed by different servers.

In one embodiment, a server 110 and/or server 120 may not be necessary or desirable for purposes of determining, developing, generating or identifying wagering opportunities for one or more player devices 102. For example, some embodiments described in this disclosure may be practiced such that this functionality is performed directly by one or more player devices 102 without a central authority (e.g., a player device comprises a trend module 110*a* or a trend module 120*a* and is operable to perform the functionality described in association therewith). For example, a player device 102 may receive or obtain live game play data (e.g., directly from one or more tables 104 or indirectly via a server 110*a* and/or a database server 140) and utilize such as repurposed game play data in an electronic baccarat game in accordance with at least some embodiments described herein. In one embodiment, any functions described herein as performed by a server 110 (or server 120) and/or data described as stored on a server 110 (or either of server 120 and database server 140) may instead be performed by or stored on (i) one or more player devices 102; and/or (ii) one or more tables 104. Additional ways of distributing information and program instructions among one or more player devices 102, one or more tables 104, a server 110, a server 120, a database server 140 and/or another server device will be readily understood by one skilled in the art upon contemplation of the present disclosure.

FIG. 2 is a block diagram of an apparatus 300 according to some embodiments. The apparatus 300 is one example of a player device 102, in accordance with some embodiments described herein. The apparatus 300 may, for example, execute, process, facilitate, and/or otherwise be associated with at least some of the processes described herein, such as determining a plurality of wagering opportunities and outputting them to a player, each of the wagering opportunities comprising a trend of outcomes, each outcome being an outcome previously obtained on a table 104. In accordance with some embodiments, apparatus 300 may comprise a dedicated gaming device located in a casino (similar to a slot machine but operable to output an electronic baccarat game in accordance with embodiments described herein).

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, one or more mechanisms which allow an operator of the apparatus 300 to interface with the apparatus 300 (e.g., which allow a player to indicate which wagering opportunity the player would like to select, indicate a wager amount, input a player identifier, etc.). In some embodiments, the input device 304 may comprise a mechanism configured to indicate to a remote server device an initiation or triggering of an event instance (e.g., that a player has actuated a "bet" mechanism (e.g., a "soft" or virtual button on an online game interface) and thus initiated selected a trend to place a wager on), such information being provided to the apparatus 300 and/or the processor 302. In some embodiments, the input device 304 may comprise a keyboard or a touch-sensitive screen. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

Figure 4:
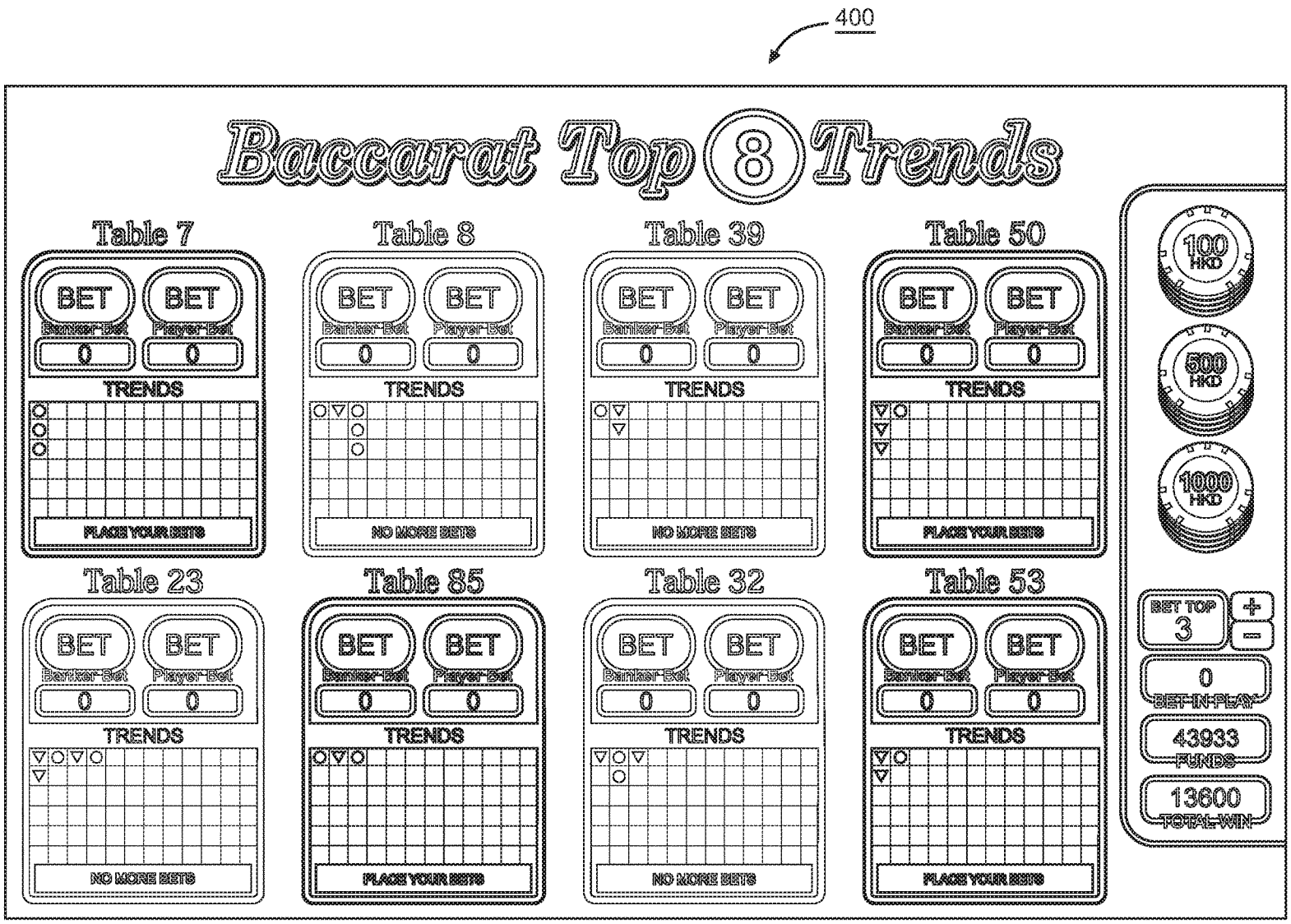
FIG. 4 comprises an example interface of a player device (e.g., a player device 102), in accordance with some embodiments.

The output device 306 may, according to some embodiments, comprise a display screen and/or other practicable output component and/or device that is operable to output information. The output device 306 may, for example, comprise a display screen via which are output outcomes, instructions, guidance, questions or information to a player of an electronic baccarat game. For example, the output device may output a game interface for an electronic baccarat game in which a player may bet on at least one of a plurality of trends and may output (i) the outcomes comprising each trend comprising a wagering opportunity; (ii) an updating of the trend by outputting the next outcome determined for a set of outcomes comprising a trend; (iii) outputting an indication of whether the player has won or lost a wager placed on a particular trend; and (iv) a current credit balance of credits available to the player for wagering (which may be adjusted to reflect bets placed by the player and payouts won by the player). An example of an electronic baccarat game interface which may be output to a player via a player device 102 is illustrated in FIG. 4 herein. Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen display or screen.

In some embodiments, the apparatus 300 may comprise any type or configuration of communication device (not shown) that is or becomes known or practicable. For example, the apparatus 300 may include a communication device such as a Network Interface Controller (NIC), a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., placement of a wager by a player) to a server (e.g., server 110 of FIG. 1 or server 120 of FIG. 2) in communication with at least one player device 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game and a bonus game program 310*b* for facilitating a bonus round of the game, if the game includes a bonus aspect. In some embodiments, the primary game program 310*a* and/or the bonus round program 310*b* may be utilized by the processor 302 to provide output information via the output device 306. In accordance with some embodiments, the memory device 308 may further sore a distinct software module or program for determining trends (sets of outcomes) to output as wagering opportunities, such as described with respect to trend module 110*b* (FIG. 1A) and trend module 120*a* (FIG. 1B); thus, the memory device 308 may additionally store a trend module. In accordance with some embodiments, the primary game program 310*a*, or a subroutine thereof, may be operable to perform at least some of the functionality described with respect to trend module 110*b* and trend module 120*a*. In some embodiments, the primary game program 310*a* may be operable to transmit and/or receive data from a trend module, whether it be a trend module internal to apparatus 300 or a trend module of a different device with which apparatus 300 communicates, such as trend module 110*b* or trend module 120*a*. For example, in some embodiments primary game program 310*a* may be operable to receive instructions and/or data which indicate particular outcome(s) to include as part of a particular trend to be made available as a wagering opportunity on a player device 102 and, as additional outcome(s) are determined for that particular trend, to update the trend to indicate the additional outcome(s) and thus the outcome of a wager a player may have placed on the particular trend.

The apparatus 300 may function as a computer terminal and/or server of an online casino or other entity operating to provide online games, receive and/or manage information related to online games. In some embodiments, the apparatus 300 may comprise a web server and/or other server device operable to accept wagers. In some embodiments, the apparatus 300 may comprise an apparatus that is operable to interact with a player of an online game. In some embodiments, apparatus 300 may comprise a plurality of devices working together to accomplish the functionality described herein with respect to FIG. 2.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 300 (e.g., externally located and/or situated).

In an effort to illustrate one example implementation of some embodiments described herein, a general baccarat game is described. In a baccarat game played on physical tables, cards are typically dealt from a shoe (an electronic device which deals cards from one or more decks placed in the shoe). Players can bet on whether the "Banker" side, the "Player" side will win or whether there will be a tie. Players can also usually bet on pairs and make some other more complex bets but for purposes of simplicity in the present example it may be assumed that the available bets are "Player", "Banker" or "Tie." Baccarat is a game in which many players enjoy trying to identify trends or patters in the outcomes of the hands from a new shoe and placing a bet based on the pattern or trend. For example, assume the past 9 outcomes of hands dealt from a show are as follows (where "P" indicates Player side win, "B" indicates Banker side win and "T" indicates a Tie):

P-P-P-B-B-B-P-P-P

On many baccarat tables for which the above 9 outcomes had been determined in the order indicated, most of the players would bet on the "Banker" side for the next hand, on the hope or prediction that the trend or pattern (3 Player wins in a row, followed by 3 Banker wins in a row, followed by 3 Player wins in a row) will continue such that the next outcomes should be a Banker win. Such a bet may be referred to as betting "with the trend" since the player is betting that the trend will continue with the next outcome. Occasionally a player may bet against the trend (betting on Player as being the next outcome in the current example). Betting on trends or patterns in a card game, such as a baccarat game, refers to placing a bet in accordance whether the player thinks the trend or pattern will continue or not (e.g., in the above example, betting with or for the trend may mean betting that the next outcome will be a Banker win while betting against the trend may mean betting that the next outcome will be either a Player win or Tie). Because betting based on perceived or identified trends or patterns is so popular with baccarat players, many casinos output the outcome history of a shoe (i.e., display the outcomes dealt from a particular shoe, in the order in which the outcomes were achieved) for each baccarat table on the casino floor. In many cases, players walk through a casino and study the displays at each table to identify trends or patterns in the outcomes and place bets in the hopes of being able to successfully predict the next outcome in accordance with the trend.

Applicants have recognized that many players would enjoy a more efficient system for viewing available trends or patterns in outcomes and placing bets in accordance therewith, such as by being able to view and place bets on multiple such trends while at a single location, even if the outcomes comprising the trends do not come from the same location (e.g., being able to bet on multiple trends from a player device, the trends being comprised of outcomes that may come from different tables). Applicants have also recognized that while one possible solution is to generate baccarat outcomes randomly (e.g., based on an RNG, as is done with slot machine games) and output them as a simulation of outcomes for a "shoe." Applicants have further recognized an alternate solution which may be preferred by those baccarat players who may be mistrustful of, or otherwise have reservations regarding, outcomes which are generated based on software or algorithms. Accordingly, Applicant provides herein a system which allows a player to place bets on trends or patterns in baccarat outcomes which are based on live game play data, outcomes actually dealt from shoes or otherwise by dealers at physical tables, rather than outcomes generated by software or random number generators separate from live table games. Thus, in accordance with some embodiments, live game play data such as outcomes dealt from one or more shoes (or otherwise dealt by dealers) at one or more physical tables is received, captured or otherwise determined. A variety of methods and systems for capturing or determining such outcomes is described herein and would be understood by one of ordinary skill in the art upon reading the present disclosure. In one embodiment, such data may be used almost immediately upon being generated (e.g., after being modified or managed, such as by combining outcomes determined at different live tables in order to develop or identify a trend, via a trend module as described herein), such that there is little or almost no perceptible delay from the time outcomes are generated at one or more live tables and when the outcomes are utilized as repurposed game play data in the form of a trend comprising a wagering opportunity at one or more player devices (e.g., one or more player devices 102). In other embodiments, live game play data may be stored (e.g., at a server device, which may or may not be stored or managed by the game provider which provides the physical tables, such as a server 110, server 120 or database server 140) and repurposed to provide additional wagering opportunities at a later time. In either embodiment (whether live game play data is utilized almost immediately upon being generated or at some later point in time after being stored), an algorithm may be used to select (e.g., randomly) outcomes determined at live tables to create or identify a sequence of outcomes. The selected outcomes comprising the may then be analyzed or reviewed to determine whether there is a trend or pattern in the selected outcomes which a player may be interested in betting on (for or against the trend or pattern).

Figure 3:
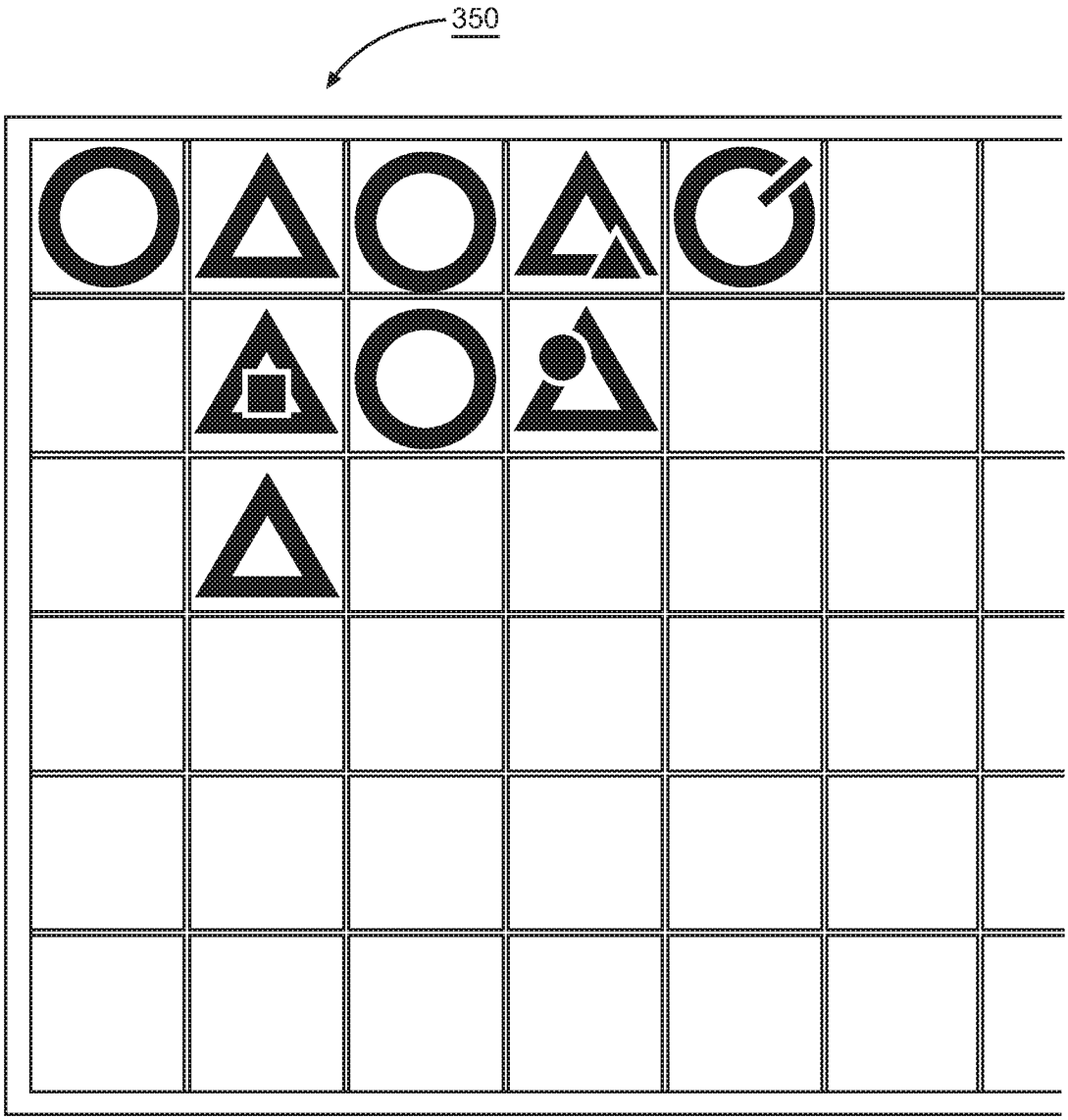
FIG. 3 comprises a grid illustrating how trends in a baccarat game may be represented to a player, in accordance with some embodiments.

Turning now to FIG. 3, illustrated therein is one example interface 350 for indicating, in a shorthand manner, a sequence of outcomes in a baccarat game, as it may be output to a player of a baccarat game. The interface 350 may represent information which is output, for example, via a display board associated with a live table (e.g., table 104) to indicate the previous outcomes of hands played on the table (e.g., the outcomes of the last twenty-five hands or the outcomes of hands since the show of the table was reshuffled, in the order they were obtained) or via a player device (e.g., outcomes selected from live game play data to develop or identify a trend to be output as a wagering opportunity on a player device 102). For example, assume a grid consisting of columns and rows is used to output outcomes of a baccarat game (e.g., to indicate a trend or pattern or to allow a player to determine whether a trend or pattern may be discerned). The following legend of symbols is utilized to represent the outcomes in interface 350: (i) a hollow black circle in a space of the grid indicates a Banker win, (ii) a hollow black triangle indicates a Player win; (iii) a filled-in black circle indicates a Banker Pair; (iv) a filled-in black triangle indicates a Player Pair; (v) a filled-in black square indicates natural; and (vi) a filled-in black rectangle indicates a tie. Of course, any other scheme for indicating outcomes may be utilized and the embodiments described herein are not dependent on any particular mechanism for indicating outcomes in a game of baccarat.

In accordance with one embodiment, the grid in interface 350 may be populated to output a trend of outcomes comprising a wagering opportunity available via a player device 102. For example, when a first outcome in a sequence of outcomes begins to be selected for a set of outcomes comprising a trend on which a player will be able to place a bet (i.e., an additional wagering opportunity is begun to be created by selecting outcomes from the live game play data as it becomes available during play of a live table game or by selecting outcomes from previously stored outcomes), the first result is indicated in the top left corner of the grid. If the second outcome is the same as the first, it is indicated in the space directly below the first outcome (in the same column). If an outcome different from the previous outcome is selected, it is indicated in the top row of the next column. This process continues for the duration of the set of outcomes being selected. Ties are displayed as a black filled-in rectangle through an edge of the most recent hollow circle (for Banker win) or hollow triangle (for Player win) that was placed. Pairs are indicated as a smaller filled-in shape on the edge of a hollow circle or triangle that was placed: a black filled-in circle for a Banker Pair and a black filled-in triangle for a Player Pair. Naturals are indicated as a black filled-in square in the middle of the hollow circle or hollow triangle representing the outcome. Of course, different symbols or indicators may be used to indicate outcomes in a simplified manner and the present example is not intended to be limiting. The interface 350 of FIG. 3, utilizing the above-described theme for representing outcomes, illustrates the following outcomes, in order: B-P-P(natural)-P-B-B-P (player pair)-P(banker pair)-Banker-Tie.

In accordance with some embodiments, a plurality of wagering opportunities (e.g., each wagering opportunity comprising a trend that a player may bet with or against) may be output to a player simultaneously at a given player device 102. FIG. 4 illustrates one example of an interface 400 which may be output to a player of a player device 102, providing the player with a plurality of wagering opportunities to wager, the wagering opportunities comprising repurposed game play data that is based on live game play data.

In accordance with some embodiments, the live game play data on which the wagering opportunities are based may comprise outcomes which occurred at one or more corresponding physical table, even if not in the same order, pattern or trend and is a compilation of outcomes which occurred from different shoes, in different sessions or at different non-consecutive points in time as compared to the live game play data from which they were selected). For example, a given player device 102 may be associated with a particular table or tables 104 from which live game play data is repurposed to provide wagering opportunities at the player device 102. In some embodiments, each wagering opportunity output to a player via a player device (e.g., via an interface such as interface 400, which outputs a plurality of wagering opportunities that a player may choose to bet on) is associated with a different table 104 (even if the outcomes comprising a given opportunity is not output in the same order as they occurred on the table). The interface 400 indicates that each wagering opportunity comprising a trend is associated with a particular table, with the number identifying the associated table output at the top of each wagering opportunity. In other embodiments, the wagering opportunities output at a given player device 102 may be from any available table 104 which is connected to the system facilitating the embodiments described herein (e.g., system 100A or system 100B) such that a given player device 102 is not associated with any particular table 104.

In some embodiments, certain wagering opportunities that are output on a game interface (E.g., such as interface 400 of FIG. 4) may not currently be available for betting and an indication of the unavailability of the wagering opportunity may be output to the player. For example, certain wagering opportunities may be output as grayed-out, crossed out or otherwise in a different manner such that they are visually distinct from wagering opportunities which are currently available for placement of wagers. Unavailable wagering opportunities may comprise tables or sets of outcomes which are not available for betting for various reasons (e.g., a trend has not yet been identified, it does not meet some criteria or filter selected by the player as a preference, etc.). Turning to the example wagering opportunities represented in FIG. 4, the player of the game output in the game interface (i) may currently bet "for" or "against" trends identified in four different sets of outcomes which are labeled with "Place Your Bets": Table 7, Table 50, Table 85 and Table 53; but (ii) may not currently wager on the wagering opportunities identified in four additional sets of outcomes which are labeled with "No More Bets": Table 8, Table 39, Table 23 and Table 32. As also illustrated in interface 400, in some embodiments a player may be provided with an opportunity to bet on a plurality of trends at once (e.g., up to eight (8) trends may be bet on in the example game interface above, but of course any practicable or desired number of trends may be made available for betting).

In one embodiment, upon a wagering establishment first opens a physical table as open for betting (e.g., Table 7) which is part of a system which uses live game play data from that table to generate or identify trends for one or more player devices, the system may automatically add a betting area corresponding to that table to a game interface of a player device. In some embodiments, the additional wagering opportunities may be based only on outcomes being dealt from the current shoe of that table (albeit perhaps not in the same order as they are being dealt on the table). In other embodiments, the additional wagering opportunities may be based on previously stored outcomes for that table or a combination of outcomes being dealt from a current shoe and previously dealt outcomes. In either embodiment, the availability of Table 7 in the game interface only when the corresponding physical Table 7 is actually open for live betting may be desirable to players, to help underline the fact that the additional wagering opportunities are based on live game play data of Table 7, even if it is not the exact live game play data (and trends) currently occurring at the physical Table 7. In other embodiments, the betting areas on the game interface (and the availability or activeness of each) are independent of which tables are currently open for betting on the wagering establishment floor (e.g., in embodiments in which repurposed game play data based on historical outcomes stored in a database is utilized to generate or identify a trend to output as a wagering opportunity on a player device).

In one embodiment, tables or determined trends to be made available for trend betting may be selected based on an input from a player. For example, in one embodiment a player may be prompted to select a wager on either Player or Banker, upon which selection the system will determine which tables have an active trend of winning outcomes for the selected side (Banker or Player) or whether a selection of historical outcomes has resulted in a trend being identified for the selected side. The system may then output on a player device the trend from either those tables which have (currently) or have had (in the past) active trends of winning outcomes for the selected side. Alternatively, a trend can be generated or identified based on the random selection of previously stored game data. In one embodiment, a player may then be provided with an additional selection opportunity, such as an opportunity to select a subset (e.g., three) of the tables with active trends or the trends identified from the selection of previously stored outcome data for use in the base game. In such an embodiment, the outcome of the next hands from the selected tables (or the next randomly selected outcome for the generated trend created by previous random selection of previously stored game outcomes) will comprise the base game.

As described herein, in one embodiment the system will randomly select outcomes from a historical set or pool of outcomes (e.g., for Table 7 in the present example but not limited to a set from a single table in other embodiments) until a trend comprising a minimum number of outcomes is identified (e.g., until a trend comprising 5 outcomes or longer develops based on the selections). The system may then pause the selection process (or at least pause outputting an indication of the next selection) and make the trend available as a wagering opportunity on a player device 102 (e.g., pause the selection and/or output of additional outcomes to the sequence of outcomes comprising the trend until a player has placed a bet "for" or "against" the trend that has developed or been generated or identified). Once a player places a wager on the trend (and/or, in some embodiments, another criteria is satisfies such as the bet timer expiring) the system will randomly select another outcome from the set of live game play data being utilized (or output the next selected outcome which may already have been selected), to resolve that wager.

In one embodiment, after a wager is resolved or a timer for placing a wager on a particular trend times out, the system may resume selecting outcomes. For example, if the trend continues the system may continue to add the new selection to the trend or previously selected set of outcomes (e.g., add a hollow circle or hollow triangle to the appropriate position of a grid, such as the grid illustrated in FIG. 3). The system may also authorize a payout to the player if a player had placed a wager "for" the trend and the next outcomes causes the trend to continue. The system may continue to select outcomes for the trend and add them to the grid/interface for that set of outcomes until it is determined that the trend has broken (or, in some embodiments, until a maximum number of selections have been made).

In one embodiment, if a trend breaks or if a trend has not yet been identified in a set of selections, the system may be operable to select outcomes in the background (i.e., without outputting an indication of selected outcomes which do not form a trend in a game interface, thus not including such selected outcomes in any wagering opportunity) until a new trend (e.g., of 5 outcomes or longer) is identified. It should be noted that with appropriate processing power in the system, it may only take milliseconds to select a sufficient number of outcomes to create or identify (e.g., via random selections of stored outcomes) a trend.

In one embodiment, a progressive bonus may be implemented in a baccarat trend-betting game such as described herein. For example, a portion of each wager placed by a participating player or via a participating device for or against a trend or pattern in game outcomes may contribute to a progressive award (or awards, as desired). In one embodiment, a player's eligibility for such a progressive award(s) may be contingent on the satisfaction of one or more conditions. Examples of such conditions include, without limitation: (i) placement of a qualifying side wager (e.g., before wagering on the trend or simultaneously with a wager on the trend); and/or (ii) maintaining a predetermined rate of play or a minimum wager in the base game. In one embodiment, a player may remain eligible for the progressive award(s) so long as the trend on which the player has wagered continues. In one embodiment, a player may not be required to continue wagering on the base game in order to maintain eligibility for the progressive award(s) once the player places a qualifying side wager on the progressive award(s). In one embodiment, a progressive award may be won or earned once a predetermined condition is satisfied by events in the game (e.g., once a trend reaches five outcomes of the same type (e.g., Banker or Player). In one embodiment, a tie may not affect a trend (e.g., an occurrence of a tie may not be considered to be a break in a trend of Banker or Player wins).

Turning now to FIG. 5, illustrated therein is an example of a table 500 which may be utilized to store live game play data for purposes of utilizing it later as repurposed game play data. For example, a table such as table 500 may be stored in database server 140 (FIGS. 1A and 1B), server 110 (FIGS. 1A and 1B) and/or server 120 (FIG. 1B). In accordance with some embodiments, data comprising outcomes which are obtained on one or more tables 104 is stored. Subsequently, a processor of a computing device that is executing instructions of a program for developing, identifying or determining a trend of baccarat outcomes to output as a wagering opportunity on a player device 102 (e.g., a processor executing instructions of trend module 110*b* or trend module 120*a*) may access a table such as table 500 in order to select (e.g., randomly, or randomly from within a set of data having one or more predetermined characteristics, such as from which a set of outcomes which occurred on a particular table)

Table 500 comprises an example structure and sample contents of a database or portion of a database (e.g., a record of a database) that may be useful in some embodiments. The data and fields of table 500 can be readily modified, for example, to include more or fewer data fields. A single database or table that is a combination of multiple databases or tables, or a configuration that utilizes multiple databases or table for a single database or table illustrated herein may also be employed. In table 500, a different reference numeral is employed to identify each field. However, in at least one embodiment in which different tables are utilized to implement one or more processes described herein, fields that are similarly named (e.g., a table identifier) may store similar or the same data in a similar or in the same data format.

As will be understood by those skilled in the art, the schematic illustration and accompanying descriptions of data contained in the sample tables presented herein is an exemplary arrangement for stored representations of information. Any number of other arrangements may be employed besides those suggested by the tables shown. For example, the embodiments described herein could be practiced effectively using more or fewer functionally equivalent databases or tables. Similarly, the illustrated entries of the databases or tables represent exemplary information only; those skilled in the art will understand that the number and content of the entries can be different from those illustrated herein. Further, despite the depiction of the databases as tables, an object-based model could be used to store and manipulate the data types of one or more embodiments and likewise, object methods or behaviors can be used to implement the processes of one or more embodiments.

Turning now to FIG. 5, the table 500 illustrated therein defines information for a plurality of outcomes obtained on one or more live table games (e.g., outcomes from one or more tables 104 of a system such as system 100A or system 100B). In particular, table 500 includes (i) a date/time drawn field 502, which indicates the date and time at which an outcome for a hand was drawn (i.e., the date/time at which the cards comprising the outcome were drawn or dealt from a shoe); (ii) a table identifier field 504, which identifies the physical table (e.g., a table 104) at which the corresponding outcome was drawn; and (iii) an outcome field 506, which indicates the outcome of the hand (e.g., Player, Banker, Tie, etc.). For purposes of simplicity, only three outcomes are illustrated in FIG. 5. In a live implementation, such a table may include thousands if not millions of outcomes (e.g., depending on how long outcomes are stored in the database). Of course, a table for storing outcomes obtained on a physical table may include many additional fields and information for each outcome. Examples of such information include, without limitation, (i) the particular cards comprising the outcome; (ii) an area (e.g., room or pit) of a casino in which the table on which the outcome was drawn is located; (iii) bet information associated with the outcome (e.g., the player identifier of each player who bet on the hand, the wager amount, the player position of the player, an amount of a payout won by a player as a result of the outcome, etc.); (iv) a unique identifier for each obtained outcome, which identifier allows additional information regarding the outcome to be retrieved); and (v) a dealer who was working at the table when the outcome was obtained.

Figure 6:
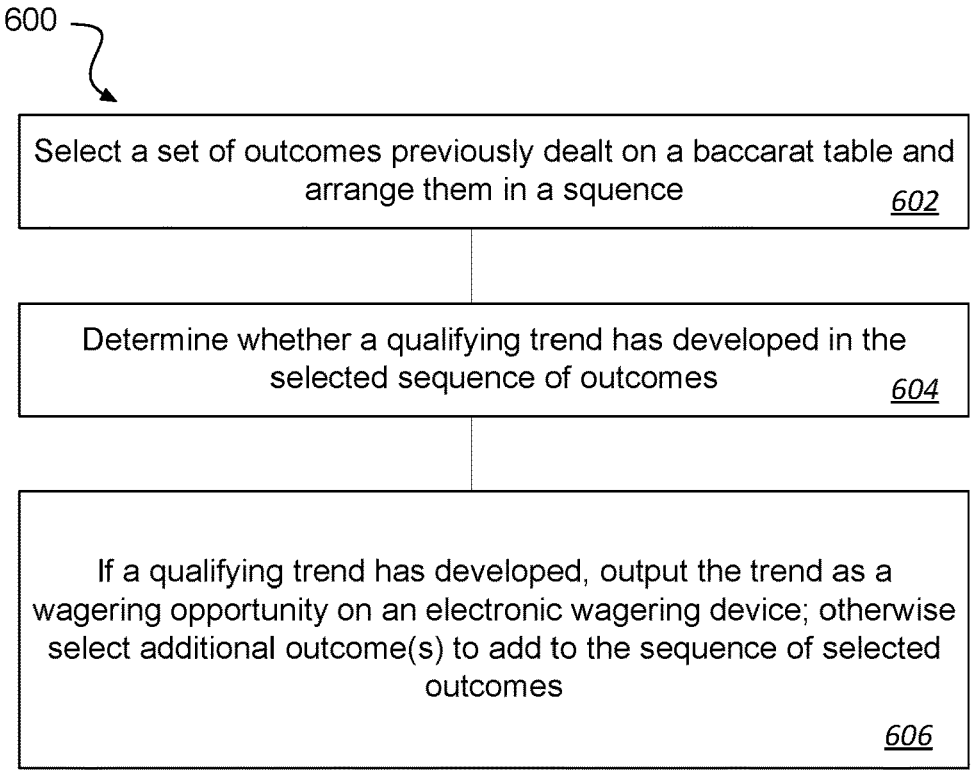
FIG. 6 comprises a flowchart illustrating one example process for generating wagering opportunities in an electronic baccarat game based on outcomes obtained in a live baccarat game, in accordance with some embodiments.

Turning now to FIG. 6, illustrated therein is a flowchart of an example process 600 which may be utilized to implement one or more embodiments described herein. Process 600 may be utilized, for example, by a trend module (e.g., trend module 110*b* or trend module 120*a*) or another program for directing a processor of a computing device to perform steps in order to output one or more wagering opportunities comprising trends or patterns of outcomes, which outcomes were previously obtained on one or more live table games. Process 600 (and all processes described herein) is exemplary only and should not be construed in a limiting fashion. For example, additional and/or substitute steps to those illustrated may be practiced within the scope of the present invention(s), in one or more embodiments one or more steps may be omitted or modified and, where practicable, steps may be performed in an order different from what is described.

In step 602, a set of outcomes previously dealt on a baccarat table (e.g., a baccarat table 104 of system 100A or system 100B) is selected. In accordance with some embodiments, selecting a set of outcomes may comprise selecting outcomes which correspond or satisfy one or more predetermined characteristics or criteria (e.g., outcomes which were dealt on a particular table and/or outcomes which were dealt within a particular time frame). In some embodiments, selecting a set of outcomes may comprise selecting outcomes and then removing from the selected set any outcomes which do not satisfy one or more predetermined characteristic or criteria. In some embodiments, selecting outcomes comprises receiving outcomes (e.g., from a table or another device) in a passive manner rather than actively selecting outcomes.

In some embodiments, step 602 may comprise, after or upon selecting the outcome(s), arranging or placing the outcomes in a sequence or order. In some embodiments, placing the plurality of outcomes in a sequence or order may simply comprise placing the outcomes into the order in which they were selected or received (i.e., as each next outcome is selected, it is added to the end of a sequence of outcomes previously selected for the present set of outcomes). In some embodiments, placing the outcomes into a sequence or order may comprise verifying that the outcomes are not in the same order as an order in which they were dealt on a baccarat table (e.g., if it is desirable to avoid having trends output as wagering opportunities on a player device which are the same trends as occurred on a baccarat table). In some embodiments, a predetermined or minimum number of outcomes may be selected in step 602 prior to the process continuing to step 604 while in other embodiments process 600 may continue iteratively back-and-forth between step 602 and step 604, upon selection of each additional outcome added to the sequence, until a qualifying trend in outcomes is identified.

In some embodiments, selecting outcomes in step 602 may comprise selecting outcomes from a stream or set of live game play data (e.g., selecting outcomes as they are dealt on one or more baccarat tables). In other embodiments, selecting outcomes in step 602 may comprise selecting outcomes from a database which stores historical or previously dealt outcomes (e.g., such as illustrated in table 500 of FIG. 5). In some embodiments, in selecting outcomes the process causes the selected outcomes which had been up to that point live game play data to be considered repurposed game play data.

In step 604, the sequence of outcome(s) selected in step 602 are analyzed to determine whether a qualifying trend has been identified or has developed. In some embodiments there may be a predetermined or maximum number of selections for a particular set of outcomes being selected, irrespective of whether a trend or pattern in the selections is identified, before the sequence of outcomes is analyzed to determine whether a trend has developed. In other embodiments an algorithm or program continues to select outcomes until a trend or pattern is identified (e.g., until at least X of the same outcome are selected consecutively) and the additional wagering opportunity based on the selected outcomes and identified trend or pattern is only output to a player upon such a trend or pattern being identified (e.g., sequence of selected outcomes which do not result in a trend or pattern being identified are not output as part of a wagering opportunity).

In accordance with some embodiments, a qualifying trend may comprise a trend of at least a minimum length (e.g., a trend which includes at least three outcomes in a discernable pattern) or which comprises a sequence of outcomes arranged in a predetermined pattern or which appears that it may fit a predetermined pattern once the next subsequent outcome is selected (e.g., an A-B-A-B pattern, an AA-BB-AA pattern, or an AAA-BBB-AAA pattern, wherein "A" and "B" represent different outcomes).

In step 606, if a qualifying trend is determined in step 604, a wagering opportunity is output to a player via an electronic player device 102. If it is determined that a qualifying trend has not developed in the sequence of outcomes selected thus far, additional outcomes are selected and added to the sequence (e.g., process 600 may return to step 602). In some embodiments, outputting the wagering opportunity on a player device may comprise activating a wagering mechanism (e.g., a "bet" button, whether a physical button or a virtual button on a touch screen) corresponding to the sequence of outcomes. For example, in some embodiments as outcomes are selected for a sequence of outcomes they are output on a display of a player device but a wagering mechanism is not activated until a trend in the outcomes has been identified. In other embodiments, none of the outcomes in a sequence is output until it has been determined that a trend has developed in the sequence, in which case the entire sequence of outcomes is output as a wagering opportunity. In some embodiments, activating a wagering opportunity may additionally comprise outputting additional information regarding the identified trend (e.g., a message or invitation to the player, explaining the trend and/or explaining which outcomes would cause the trend to be continued vs. which outcomes would cause the trend to be broken).

It should be noted that a system operating in accordance with embodiments described herein may store a very large number of outcomes (e.g., hundreds of thousands or millions), which were dealt at physical tables at different times, from different shoes, at different tables or even at different wagering establishments. In one embodiment, the system selects outcomes for an additional wagering opportunity from among outcomes of a plurality of tables. In another embodiment, the system may select outcomes from live game play data for a particular physical table when it is selecting a set of outcomes for a particular wagering opportunity. For example, a game interface for a game comprising the additional wagering opportunities on trends or patterns in outcomes may allow a player to bet "for" or "against" trends or patterns associated with particular tables and different areas of the interface may be labeled as being associated with particular tables (as illustrated in the example of FIG. 4). In one embodiment, the areas of the game interface which are labeled as being associated with particular tables may correlate to like-numbered physical tables located in the wagering establishment with which the player is placing wagers (whether remotely or at a player device also located in the wagering establishment). In one embodiment, when the system selects outcomes from live game play data to be repurposed as additional wagering opportunities, it does so based at least on criteria such as an identifier of the physical table from which the live game play data was obtained (e.g., "Table 7" on the game interface may provide additional wagering opportunities created by selecting (e.g., randomly) outcomes which were previously dealt at the physical "Table 7" and stored for future use by the system).

It should be noted that, in at least some embodiments, outcomes comprising live outcome data are selected one at a time and any trend or pattern of outcomes which may have occurred during a live game are not merely copied and reused as an additional wagering opportunity on the player device. This may be desirable to avoid the possibility that a player who had witnessed the trend or pattern as it occurred at the physical table during the live table game would recognize it when it is output as an additional wagering opportunity at a player device and thus have an advantage in remembering what outcome occurred next in the sequence of outcomes comprising the trend. Thus, in at least some embodiments the system selects outcomes one at a time and does not select outcomes which occurred consecutively during the live game. In effect, the system is creating new and unique trends and patterns of outcomes by selecting and putting together a sequence of outcomes from different batches of outcomes, which may have come from different shoes, occurred at non-consecutive hands or points in time.

In some embodiments, a player playing at a player device 102 may be able to wager in "real time" on live outcome data of a physical table. For example, as outcomes are determined at a physical table, such live outcomes are forwarded through the system and output on a player device 102, such that a player playing at a player device 102 may be able to wager on any trend that emerges as outcomes are determined on the table. Thus, the player playing at a gaming device 102 may effectively be viewed as an additional player who is playing at the table 104, albeit remotely.

In accordance with some embodiments, the process 600 may include additional steps after step 604. For example, in some embodiments the process 600 may include steps such as (i) determining whether a player has placed a wagering on the wagering opportunity output in step 604; (ii) determining whether the player has wagered that the trend will continue with the next outcome added to the sequence of outcomes comprising the trend or whether the player has wagered that the trend will be broken with the next outcome added to the sequence of outcomes comprising the trend; (iii) selecting, receiving or otherwise determining the next outcome to be added to the end of the sequence; (iv) determining, based on the next outcome and the player's wager, whether the player has won or lost his wager; and (v) causing a payout to be provided to the player if the player has won the wager.

In accordance with some embodiments, if the next outcome added to a trend continues the trend, an additional wagering opportunity may be output based on the extended sequence. This may be done irrespective of whether a player has placed a wager on the trend prior to the next outcome being added. For example, assume a trend determined in step 604 comprises B-B-B-B-B and this trend is output as a wagering opportunity in step 606. Further assume that the next outcome determined (after the trend is output as a wagering opportunity in step 606) is also a B outcome, meaning the trend has continued with the next outcome. In some embodiments, a wagering opportunity may then be output to a player for the trend "B-B-B-B-B-B". Thus, if the player had wagered previously on the trend "B-B-B-B-B" (e.g., irrespective of whether he had won or lost this wager), the player may then be allowed to bet on whether the trend "B-B-B-B-B-B" will continue with the next outcome added to the sequence comprising the trend. In some embodiments, additional wagering opportunities may be made available for the trend each time an outcome is added to the trend so long as the trend continues. In some embodiments, a player may be allowed to wager on whether a trend will continue with the next plurality of outcomes (e.g., with the next two outcomes, rather than just with the next one outcome).

As can be appreciated upon a review of the present disclosure, in accordance with some embodiments Applicants have essentially created a random number generator for wagering opportunities comprising trends (a plurality of outcomes arranged in a sequence which comprises a pattern in the outcomes) based on either live game play data or historical game play data (live game play data stored in a memory and accessed at a later time) of one or more baccarat tables.

It is contemplated that the systems and methods of the invention may be applied to any live, electronic or partially electronic game in which random game play data is generated, such as baccarat, roulette, craps, poker-based table games or any other type of live game and for which such live game play data may be stored and repurposed to provide additional wagering opportunities. In accordance with some embodiments, such additional wagering opportunities may comprise opportunities to wager on whether a pattern or trend in outcomes will continue, wherein the outcomes comprising the pattern or trend are randomly selected from stored live game play data (e.g., from stored live game play data of a plurality of tables or sessions).

Systems configured to facilitate processes and embodiments described herein may comprise components such as an input device at a physical table for receiving live game play data. Such an input device may comprise, for example, at least one of a button panel, keyboard, keypad, optical card reader or any other device configured for inputting, either automatically or manually, live game play information, such as card information comprising an outcome, to the system. Such live game play data may then be transmitted over a network and stored in a memory of a server device for subsequent use.

The live game play data provided to the system may be provided as game results or outcomes, such as a player win, banker win or tie in the case of baccarat. Alternatively, game play data may include the randomly generated card information or symbols which may then be processed by one or more system data processors in combination with data storage devices or memory containing game information to determine a game outcome. Game play data may further include wagering information, which may be received by a system for detection of the monetary value of the gaming chips wagered, including chips with RFID tags embedded therein and an RFID sensing device installed or operatively associated with wagering locations defined on a physical gaming table.

A system controller, which may take any form, including one or more general purpose computers, specific purpose computers or servers, may receive, determine, store, analyze, categorize, select and/or repurpose the live game play data for one or more additional wagering opportunities on a player device. The player device may include any type of display, such as a cathode-ray tube monitor, liquid crystal display, plasma display, organic light emitting diode display, or the like, which may also be touch-sensitive or touchenabled. A player device may comprise any platform capable of receiving and transmitting data, including "thin-client" platforms or platforms which do not process game play data and "smart" platforms or platforms which process game play data. A player device may be stationary, such as a slot machine or one or more portable electronic devices such as smart phones, computer tablets, portable media players, laptop computers, desktop computers, smart TV, and the like. Additionally, the communication network used by the system can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art, or connected to the system via the Internet, local area network, wide area network, cellular telephone network or wireless or wired network.

The system is configured to provide the repurposed game play data at one or more player terminals may also facilitate or comprise a platform operable for other purposes, such as a phone or electronic gaming machine, thus allowing the player to selectively alternate between a game or features provided by the local platform and the system of the invention.

The repurposed game play data may be displayed in any way which facilitates wagering via a player device. For example, the repurposed game play data may be displayed on a touch-sensitive display screen with user interface that permits scrolling, parsing, search and organizing the data to facilitate finding wagering opportunities of interest. The wager amount may be drawn from a wagering account at a remote location or by inserting currency or inputting credit at the local platform if possible. Once the wager is placed, the wager may be resolved based on additional repurposed game play data received, either from games being played in real-time or by retrieving game play data from a data storage device.

In some embodiments, systems and processes consistent with embodiments described herein may be operable to analyze repurposed game play data (e.g., a set of outcomes selected from a pool of available live game outcomes) to provide a variety of side wagering opportunities. For example, wagers may be placed on specific indicia associated with the cards dealt in a game, such as the colors, hands, ranks, etc. at one or more gaming tables from which game play data is received. However, the indicia may include any information that is randomly generated during game play, such as dice rolls or roulette outcomes.

It should be understood that systems such as those described herein may be adapted and configured to function independently or may also interact with other systems or applications, such as for example, a casino management system or player tracking system. As such, the wagering data may be recorded and stored in connection with player information retrieved from their respective data communication devices.

Those skilled in the art will readily appreciate that any of the systems and methods described herein may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to play the game as described herein.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

Although several embodiments, examples and illustrations are disclosed herein, it will be understood by those of ordinary skill in the art that the invention described herein extends beyond the specifically disclosed embodiments, examples and illustrations and includes other uses of the invention and obvious modifications and equivalents thereof. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

What is claimed is:

1. A system for facilitating an electronic baccarat game by repurposing live game play data, the system comprising:

a plurality of baccarat tables, each baccarat table operable to facilitate a live baccarat game playable by a plurality of players present at the baccarat table;

a plurality of electronic player devices, each electronic player device dedicated to facilitating placement of wagers on trends in a baccarat game, each trend generated from a plurality of outcomes previously dealt for at least one baccarat table of the plurality of baccarat tables and comprising outcomes that may be sourced from more than one baccarat table of the plurality of baccarat tables or outcomes that are in an order different than that in which they occurred during a live game;

wherein each electronic player device is operable to output in a player interface, at a given time, a plurality of activated wagering opportunities, each such wagering opportunity representing a distinct trend; and a processor for generating a wagering opportunity for at least one electronic player device of the plurality of electronic player devices, the processor operable with a program to:

(a) access game play data, the game play data defining a plurality of outcomes which were determined during a baccarat game of at least one baccarat table of the plurality of baccarat tables, each outcome comprising an indication of cards defining the hand corresponding to the outcome and each outcome being included in the plurality of outcomes irrespective of whether any player who placed a wager on the hand won the wager;

(b) analyze the plurality of outcomes to determine whether a trend is present within the plurality of outcomes, wherein determining whether a trend is present comprises determining whether there is at least one first characteristic common to at least a subset of the plurality of outcomes appearing in a sequence of at least a minimum length;

(c) only if it is determined that a trend is present within the plurality of outcomes, continue to step (d), otherwise select at least one additional outcome from the game play data, add the first additional outcome to the plurality of outcomes and return to step (b);

(d) cause a wagering opportunity to be activated on an electronic player device of the plurality of electronic player devices such that the wagering opportunity is activated responsive to determining that the trend is present in the plurality of outcomes;

(e) add, based on the game play data, at least one first additional outcome to the plurality of outcomes; and (f) determine whether the trend has continued upon the at least one first additional outcome being added.

2. The system of claim 1, wherein the at least one first characteristic comprises two different characteristics that appear in a pattern within the sequence of at least the minimum length.

3. The system of claim 1, wherein the processor is further operable with the program to:

cause a first payout to be output to the player if it is determined that the trend has continued upon the at least one first additional outcome being added.

4. The system of claim 3, wherein the processor is further operable with the program to:

add, based on the game play data and after the at least one first additional outcome is added to the plurality of outcomes, at least one second additional outcome to the plurality of outcomes; and determine, based on the at least one second additional outcome being added to the plurality of outcomes, whether the trend has continued upon the at least one second additional outcome being added; and cause a second payout to be output to the player if it is determined that the trend has continued upon the at least one second additional outcome being added.

5. The system of claim 1, wherein the processor is further operable with the program to:

add, based on the game play data and after the at least one first additional outcome is added to the plurality of outcomes, at least one second additional outcome to the plurality of outcomes; and determine, based on the at least one second additional outcome being added to the plurality of outcomes, whether the trend has continued upon the at least one second additional outcome being added; and cause a first payout to be output to the player if it is determined that the trend has continued upon both the at least one first additional outcome and the at least one second additional outcome being added.

6. The system of claim 1, wherein the processor being operable with the program to add the at least one first additional outcome comprises the processor being operable with the program to add the at least one first additional outcome based on the game play data only after the player has placed a wager on the activated wagering opportunity.

7. The system of claim 1, wherein the game play data comprises previously stored game play data.

8. The system of claim 1, wherein the game play data comprises live game play data of outcomes as they are dealt on at least one baccarat table of the plurality of baccarat tables.

9. The system of claim 8, wherein the at least one first additional outcome comprises an outcome that was added to the live game play data of outcomes after the game play data was accessed in step (a).

10. The system of claim 1, wherein the processor being operable with the program to access the game play data in step (a) comprises the processor being operable with the program to select a predetermined number of outcomes from the game play data.

11. The system of claim 1, wherein the processor being operable with the program to access the game play data in step (a) comprises the processor being operable with the program to select from the game play data the plurality of outcomes by selecting outcomes corresponding to a third characteristic.

12. The system of claim 11, wherein the third characteristic is that the outcomes were dealt on a particular baccarat table, such that all of the outcomes comprising the plurality of outcomes were originally dealt on the particular baccarat table.

13. The system of claim 1, wherein the processor being operable with the program to access the game play data in step (a) comprises the processor being operable with the program to select each outcome of the plurality of outcomes from the game play data on an individual and random basis and generate an original sequence of outcomes therefrom, such that two outcomes which were first dealt on a baccarat table in a particular order are not necessarily placed in the original sequence in the particular order.

14. The system of claim 13, wherein the processor being operable with the program to generate the original sequence of outcomes comprises the processor being operable with the program to place the plurality of outcomes into the original sequence based on an order in which the outcomes were selected from the game play data.

15. The system of claim 1, wherein the processor being operable with the program to access game play data comprises the processor being operable with the program to receive an indication of the plurality of outcomes from at least one baccarat table of the plurality of baccarat tables.

16. The system of claim 1, wherein the processor is a processor of the electronic player device of the plurality of electronic player devices.

17. The system of claim 1, wherein the processor is a processor of a computing device which is distinct from the plurality of baccarat tables and the plurality of player devices.

* * * * *